United States Patent [19]

Williams

[11] Patent Number: 4,526,238

[45] Date of Patent: Jul. 2, 1985

[54] LAND LEVELING DEVICE

[75] Inventor: Leslie F. Williams, Buttonwillow, Calif.

[73] Assignee: Eagle Tractor Company, Inc., Buttonwillow, Calif.

[21] Appl. No.: 571,470

[22] Filed: Jan. 17, 1984

[51] Int. Cl.[3] ..... E02F 3/62

[52] U.S. Cl. ..... 172/780; 172/421; 172/4.5; 172/417

[58] Field of Search ..... 172/780, 799.5, 781, 172/413, 4.5, 779, 784, 328, 421, 417

[56] References Cited

U.S. PATENT DOCUMENTS

| | | | |
|---|---|---|---|
| 1,247,135 | 11/1917 | Monroe | 172/799.5 |
| 2,725,799 | 12/1955 | Day | 172/780 |
| 3,172,218 | 3/1965 | Constantin | 172/413 X |
| 3,684,031 | 8/1972 | Reynolds | 172/784 |
| 3,704,754 | 12/1972 | Layton | 172/815 |
| 4,057,111 | 11/1977 | vander Lely | 172/49.5 |

*Primary Examiner*—Richard J. Johnson

*Attorney, Agent, or Firm*—Huebner & Worrel

[57] ABSTRACT

A land leveling device having a frame supported on wheels for earth traversing movement forwardly thereof; a first pair of blades borne by the frame in rearwardly convergent oblique relation to each other; a second pair of blades borne by the frame rearwardly of the first pair in rearwardly divergent oblique relation to each other; and means for deploying the frame in a substantially horizontal attitude substantially continuously during said earth traversing movement.

10 Claims, 16 Drawing Figures

LAND LEVELING DEVICE

BACKGROUND OF THE INVENTION

1. Field of the Invention

The present invention relates to a device for leveling soil in orchards and the like and more particularly to such a device adapted to be towed behind a tractor or the like, the device providing a first soil engaging blade assembly adapted to engage soil and to direct such soil into an elongated pile disposed longitudinally of the path of travel of the tractor and a second blade member adapted to engage the soil so deposited and to substantially evenly disperse such soil in a substantially common plane.

2. Description of the Prior Art

The use of devices for the leveling or other grading of earth surfaces has long been known. Representative of such devices are earth levelers adapted to be moved under their own power or by towing along a predetermined course desired to be graded. Such devices commonly provide a single blade having an earth engaging portion, the blade being mounted on the device whereby the blade engages the earth to be leveled at an angle substantially oblique to the path of travel of the device. Portions of the soil so engaged tend to be moved across the blade surface substantially transversely to the line of travel in a direction from the leading portion of the blade toward the trailing portion.

While conventional earth leveling devices have proved satisfactory in varying degrees for their intended purposes, they are attended by a number of deficiencies and drawbacks. For instance, it is often seen that the amount of soil or the like carried toward the trailing portion of the blade by the movement forwardly of the device is either too great or too little to result in an even dispersal of the soil. It is an accepted principle that in the leveling of soil and the like it is desirable to have a combination of removal of dirt from those areas that are relatively built-up and a deposit of soil on those areas which are rutted or relatively shallower. However, when a device having a single oblique blade member is caused to move along a path in which the relatively shallow soil is that over which the leading edge passes, and the relatively built-up soil is that engaged by the trailing edge, it is found that the blade must be in to a greater depth than is desirable to permit the evening of the soil in a single pass. If the leading edge is not adjusted downwardly to bring it into engagement with the soil, but rather is permitted to ride above, and out of engagement with, the shallow portions, the shallow portions will not be relatively filled in or brought into a level disposition relative to the previously built-up areas because no dirt will be carried along the blade to that portion of the soil. Thus, it is often found that a single blade device necessitates two or more passes along a single row or course to be leveled, in order to effect a substantially horizontal leveling of the entire desired course.

In almond orchards and the like in which it is common to have the trees thereof planted in substantially parallel rows atop raised berms to define courses or paths therebetween, it is desirable, for irrigation purposes, to have as level a course between the berms as possible. Use of a conventional, singlebladed leveling device to remove ruts and otherwise level the course between the two berms often results in the deposit of excessive amounts of soil on the berm nearest the trailing edge of the oblique blade, whereby the course between the berms is caused to be bounded by asymmetrical borders.

Of further concern in many areas in which land leveling orchards or the like is desirable, is the inability of many conventional devices to provide means for maintaining the blade thereof in a substantially horizontal attitude, regardless of the degree of transverse pitch of the course over which the device is caused to travel. Those devices providing automated leveling generally do so by causing the angle of the blade itself to change relatively to the frame on which it is carried.

Still further, a problem common to many conventional land leveling devices is that the blade portions thereof are of a single, predetermined, non-adjustable length. Thus, a given device might have limited or no utility in a number of work environments due to the blade thereof being too long to fit between the berms, for instance, without damage thereto during the leveling operation; or too short efficiently to level the entire course between the berms, thus necessitating multiple, repeated passes to accomplish asemblance of leveling.

Therefore, it has long been known that it would be desirable to have a land leveling device which is adapted for use in myriad land leveling operations and environments wherein such device is capable of substantially evenly dispersing the surface soil of a desired course in a single pass and wherein the device is adjustable for use in a wide variety of courses of varying widths. Moreover, it has long been known that it would be desirable to have such a land leveling device which is adapted automatically to maintain the blade thereof in a substantially horizontal attitude virtually continuously during the operation thereof.

OBJECTS AND SUMMARY OF THE INVENTION

Therefore, it is an object of the present invention to provide an improved land leveling device adapted to level selected surfaces with an efficiency and precision heretofore unattainable.

Another object is to provide such a device which is adapted for use in a wide variety of work environments and which can be used to level selected courses of a wide range of widths.

Another object is to provide such a device which provides means selectively operable automatically to maintain the blade thereof in a predetermined, horizontal attitude relative to the earth surface to be leveled as the device is caused to travel along a selected course.

Another object is to provide such a device which is adapted to be towed behind a vehicle, such as a tractor or the like, and which is characterized by a high degree of maneuverability thereof when being so towed.

Another object is to provide such a device which is capable of lightweight yet sturdy construction.

Another object is to provide such a device which can be constructed at a reasonable cost and sold for a nominal price.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
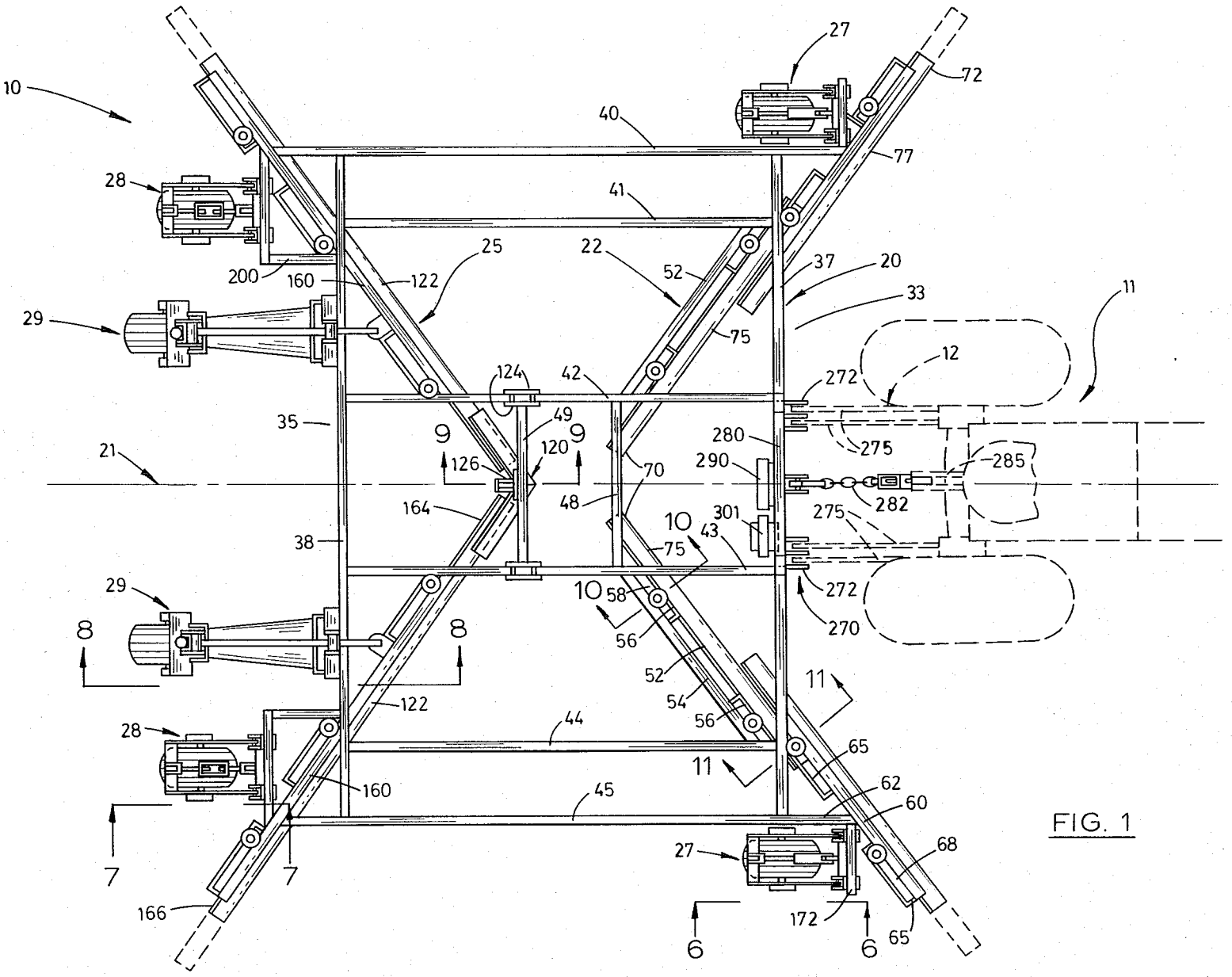
FIG. 1 is a top plan view of the land leveling device of the present invention shown in a typical operative environment.
Figure 2:
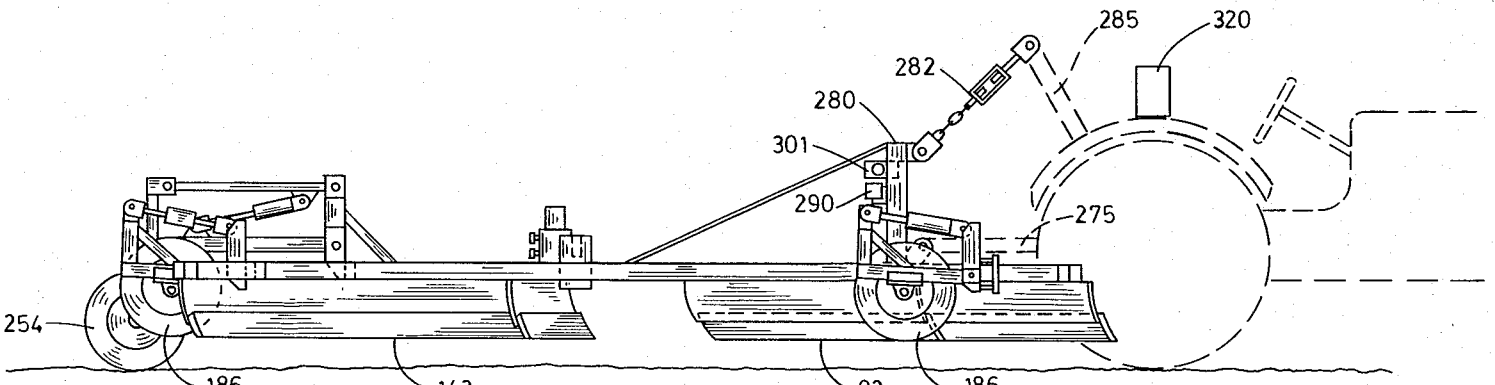
FIG. 2 is a side elevation taken on line 2—2 in FIG. 1.

Referring more particularly to the drawings, the land leveling device embodying the principles of the present invention is designated generally by the numeral 10 in FIGS. 1 and 2. The device is shown therein in a typical operative environment operably connected to any suitable tractor 11 or other prime mover, depicted schematically in phantom lines and having a conventional three-point hitch 12 mounted on the rear thereof.

As can best be seen in FIGS. 1 and 2, the device 10 generally provides a substantially flat frame 20 having a longitudinal midline 21 and mounting a first, or forward, blade assembly 22 and a second, or rearward, blade assembly 25. The frame further mounts a spaced first pair of wheel assemblies 27 in proximity to the first blade assembly 22. The frame mounts a second pair of wheel assemblies 28 spaced from each other in proximity to the second blade assembly 25. Preferably, although not necessarily, the frame mounts a pair of caster wheel assemblies intermediate the second pair of wheel assemblies 28.

The device 10 further provides a hydraulic assembly 30. The hydraulic assembly 30 has been removed from the device 10 in FIGS. 1 and 2 to facilitate clear illustration thereof. A schematic diagram of the hydraulic assembly 30 is provided in FIG. 15.

As can best be seen by reference to FIG. 1, the frame 20 has a forward or leading portion 33 adapted operably for connection to the three-point hitch 12 of the tractor 11. The frame 20 further provides a rearward or trailing portion 35 disposed remotely from the forward portion 33. The forward portion 33 has a transverse support beam 37. Similarly, the rearward portion 35 provides a transverse support beam 38. The transverse beams 37 and 38 are substantially straight and of substantially equal length. They are spaced from each other a predetermined distance in substantially parallel relation. The beams are rigidly interconnected by a plurality of substantially straight, elongated, longitudinal braces 40, 41, 42, 43, 44 and 45 whereby the frame is provided a substantially inflexible structure. The centermost longitudinal braces 42 and 43 are rigidly interconnected by a first or forward transverse brace 48 and a second or rearward transverse brace 49 spaced from each other and disposed substantially parallel to and spaced from the first transverse beam 37 and second transverse beam 38.

The first or forward blade assembly 22 provides a pair of spaced blade subassemblies 52 of substantially identical dimensions and construction spaced from each other and carried substantially obliquely on the forward portion 33 of the frame 20. As can best be seen in FIG. 1, the blade subassemblies 52 are substantially symmetrically disposed about the midline 21 in a rearwardly convergent attitude. Reference to the structure of the blade subassemblies 52 is made in the singular hereafter as it will readily be understood that such description is equally applicable to either of the two blade subassemblies.

Each subassembly provides a first oblique mounting strut 54 mounted obliquely in rigid interconnecting relation on longitudinal braces 43 and 44. The first strut provides a pair of spaced adjustment brackets 56 mounted on the leading portion thereof, each bracket providing a channel portion 58 therein of predetermined length in a disposition substantially parallel to the longitudinal axis of the strut 54.

The blade subassembly 52 provides a second strut 60 obliquely mounted as by welding or the like on the forward portion 33 of the frame, the strut being connected to the forward transverse beam 37 and a forwardly extending longitudinal brace 62. As can best be seen in FIG. 1, the longitudinal braces 62 are substantially continuous with and preferably a part of the outermost longitudinal braces 40 and 45, respectively. The second strut mounts a pair of adjustment brackets 65 on the leading or forwardly disposed aspect thereof spaced longitudinally from each other therealong and providing adjustment channels 68 therethrough.

The blade subassemblies each provide a first, innermost end portion 70 disposed proximally to the midline 21 and a second outermost end portion 72 spaced from the inner end portion 70 remotely from the midline. Each blade subassembly provides an inner blade 75 and an outwardly adjustable outer blade 77.

Figure 11:
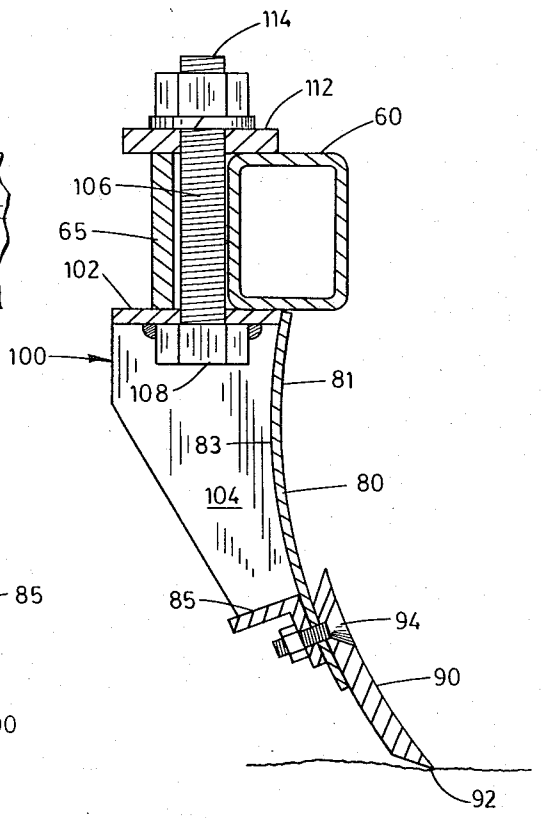
FIG. 11 is a somewhat enlarged view taken on line 11—11 in FIG. 1.
Figure 12:
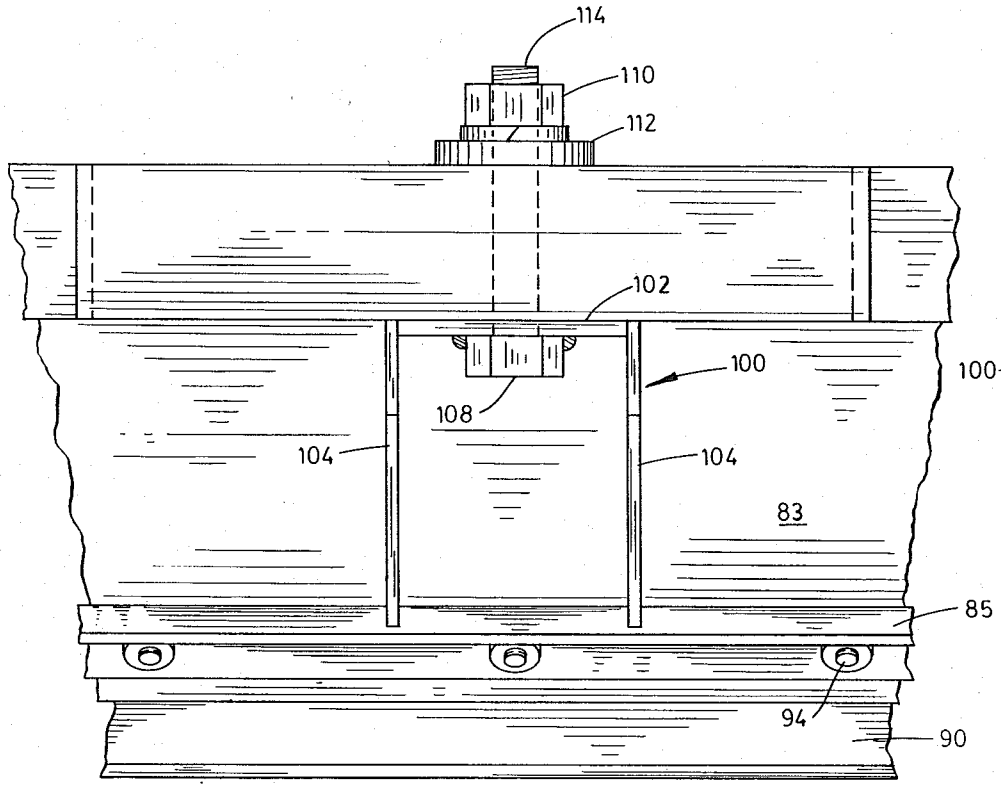
FIG. 12 is an enlarged fragmentary rear elevation of the portion of the device shown in FIG. 11.

As can best be seen in FIGS. 11 and 12, the outer blade 77 provides an elongated, forwardly concave deflector portion 80 having a substantially smoothly curved forward surface 81 and an opposite rearward surface 83. An elongated, L-shaped reinforcing plate 85 extends substantially the length of the rear surface 83 and is secured thereto as by welding or the like. The outer blade 77 further provides a cutting or earth grading portion 90 forwardly convex in an arc substantially concentric with that of the deflector portion 80. The grading portion has a lowermost, elongated, substantially straight cutting edge 92 along its entire length disposed substantially parallel to the plane in which the frame lies. The grading portion 90 is secured on the lowermost aspect of the forward surface of the deflector portion 80 by a plurality of screws, bolts 94 or the like. A pair of mounts 100 are secured on the rearward surface 83 of the deflector portion 80, as by welding or any other suitable means. As can best be seen in FIG. 12, each mount provides a horizontal mounting plate 102 and a pair of downwardly extending, substantially parallel brace plates 104. As can best be seen by reference to FIGS. 11 and 12, the outer blade 77 is secured on second strut 60 by a pair of bolts 106 inserted individually within and through the channel 68 of the bracket 65. The bolt provides a fixed head 108 adapted to be brought into engagement with the horizontal plate 102 and a nut 110 and washer 112 adapted screw-threadably to be secured on the opposite end portion 114 of the bolt 106 whereby the horizontal plate 102 is biased against the lowermost aspects of the second strut 60 and the bracket 65 to retain the outer blade thereon in substantially secure immovable depending relation.

Figure 10:
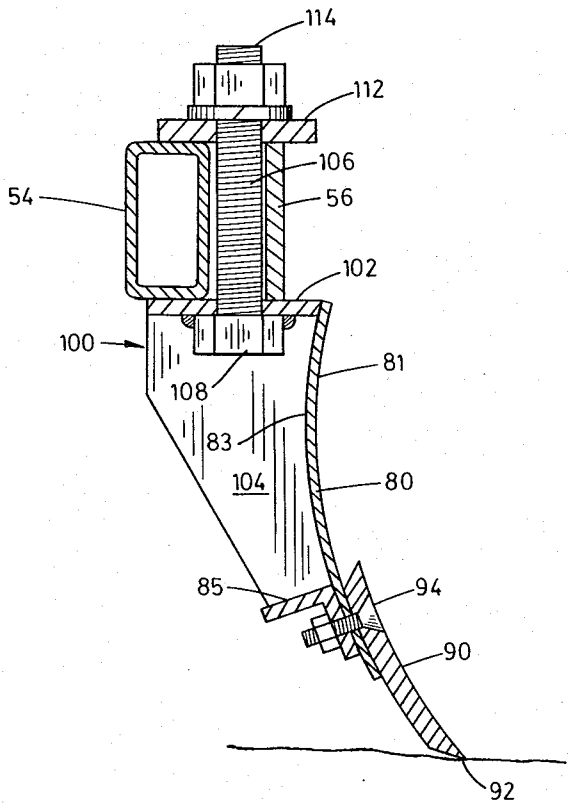
FIG. 10 is a somewhat enlarged view taken on line 10—10 in FIG. 1.

The inner blade 75 is constructed and dimensioned substantially identically to the outer blade 77, as can best be seen upon reference to FIG. 10. Therefore, like reference numerals and descriptive terminology being equally applicable to the inner blade 75 and the outer blade 77, a description thereof is not presented here in order to avoid repetition, and reference is directed to the above description in relation to both the inner and outer blades 75 and 77. However, it will be noted that although the inner blade 75 is mounted by bolts 106 inserted through brackets 56 in the fashion described in relation to the outer blade 77 mounting structure, it will be noted upon reference to FIGS. 10 and 11 that the brackets 56 are disposed on the forward aspect of the first strut 54 while the brackets 65 are disposed on the rearward aspect of second strut 60. Thus, the cutting edge 92 of inner blade 75 and outer blade 77 are disposed in substantially parallel relation with the deflecting portions 80 and grading portions 90 thereof disposed in incomplete, overlaying relation.

As can best be seen in FIG. 1, the inner blade 75 and outer blade 77 are telescopically adjustable to dispose the inner end portion 70 and outer end portion 72 of the blade subassembly in a variety of attitudes of extension along the struts on which the blades are mounted, the range of such motion being determined by the length of the channels 58 and 68, respectively, as is discussed in greater detail in the operation section below.

Figure 9:
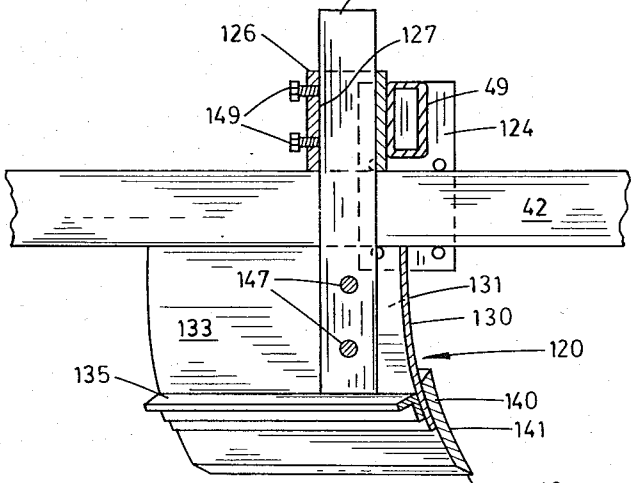
FIG. 9 is an enlarged transverse section taken on line 9—9 in FIG. 1.

The second, or rearward, blade assembly 25 is substantially symmetrical about the midline 21. As can best be seen in FIGS. 1, 9 and 13, the rearward blade assembly 25 provides a shield portion 120 and a pair of substantially identical, rearwardly divergently disposed blades 122. The shield 120 is mounted on the rearward transverse brace 49, which is secured in interconnecting relation on longitudinal braces 42 and 43 by mounting plates 124, as by bolts, welding or the like. A mounting sleeve 126 having a substantially rectangular bore 127 therethrough is secured on the transverse brace 49 as by welding or the like to dispose the longitudinal axis of the bore 127 in a substantially perpendicular attitude relative to the longitudinal axis of the transverse brace.

The shield 120 provides a pair of deflector portions 130 fused obliquely to each other and each providing a substantially concave, forward surface 131 and an opposite, rearward surface 133. An L-shaped reinforcing plate 135 is secured on the owermost aspect of the rearward surface 133, as by welding or the like. Similarly to the inner blade 75 and outer blade 77 of the blade subassemblies 52, the shield 120 provides a grading blade portion 140 having a forward surface 141 concavely curved substantially concentrically with the forward surface 131 of the deflector portion 130. The grading blade portion 140 provides a lowermost, substantially linear cutting edge 142, the edges 142 being substantially symmetrically angularly disposed obliquely relatively to the midline. An elongated mounting post 145 is secured to the rearward surfaces 133 of the shield 120, as by mounting rods 147 or other rigid bracing means. The mounting post is adapted to be inserted into and through the bore 127 of the sleeve 126 and securely retained therein in a substantially upright attitude by set screws 149, or the like, as can best be seen in FIG. 9, to dispose the edges 142 in a common plane with the cutting edges 92.

A pair of rearwardly divergent mounting struts 160 are rigidly secured on the rearward portion 35 of the frame 20 to support the blades 122 of the rearward blade assembly 25. The struts are disposed in a substantially common plane with the frame 20. Each strut provides three substantially identical mounting brackets 65 rigidly secured as by welding or the like, on the rearwardmost portion thereof. The brackets are substantially identical in construction and dimension to the brackets 65 of subassemblies 52 and provide channels substantially identical to the channels 68, and therefore attention is invited to the description provided above of the brackets 65 and channels 68, which will be understood as being equally applicable to the channels and brackets of the struts 160.

The blades 122 each provide an innermost end portion 164 and an opposite, outermost end portion 166 remote therefrom. Each blade 122 is constructed with a cross-sectional configuration substantially identical to that of the outer blade 77 and the blades 122 are each secured on their respective struts 160 substantially in the manner described above in reference to FIGS. 11 and 12, and attention is invited to such description. The blades 122 differ from the outer blade 77 and inner blade 75 substantially solely as to length in that the blades 122 each are longer than either the inner blade 75 or outer blade 77.

Figure 13:
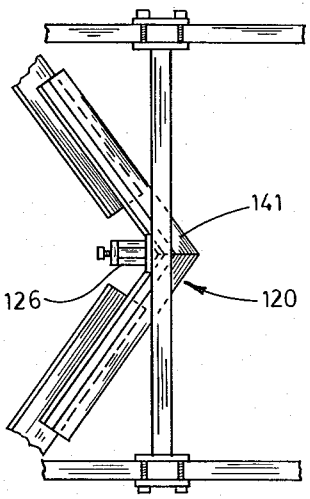
FIG. 13 is an enlarged fragmentary top plan view of a portion of the device of FIG. 1.

Upon reference to FIGS. 1 and 13, it will be seen that the innermost end portion 164 of each blade 122 is disposed rearwardly of the shield 120. The blades are slidably mounted for selective adjustment in a variety of attitudes of extension to dispose the innermost end portion 164 thereof a selected distance from the midline 21. However it is preferable that the brackets 65 and channels 68 be dimensioned to limit the range of such extension whereby the innermost end portion 164, even when maximally spaced from the midline 21, is at least partially disposed rearwardly of, and in shielded relation to, the shield 120. The blades 122 are preferably each mounted and dimensioned to dispose the cutting edge 92 thereof in a substantially common plane with the cutting edges 142 of the shield 120 and also in a common plane with the cutting edges 92 of the blade subassemblies 52.

Figure 6:
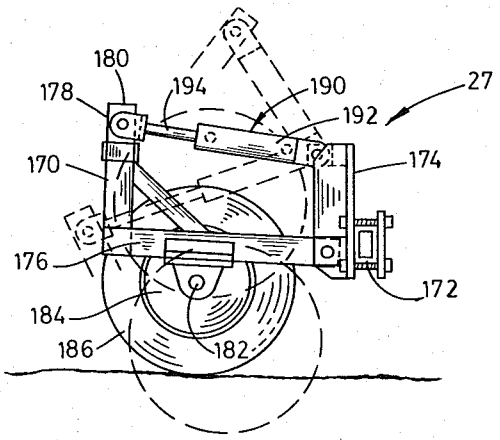
FIG. 6 is a somewhat enlarged, side elevation of a portion of the device taken on line 6—6 in FIG. 1 showing alternate positions thereof in phantom lines.

The first, or forward wheel assemblies 27 are best understood by reference to FIGS. 1 and 6. As shown therein, each wheel provides a frame 170 secured upon a transverse strut 172 extending substantially perpendicularly from and rigidly secured on the longitudinal brace extension 62. The frame 170 provides a substantially upright mounting plate 174 to which are pivotally secured a pair of longitudinally elongated mounting arms 176 spaced transversely from each other in substantially parallel relation and adapted to pivot about a substantially common axis substantially parallel to the mounting strut 172. The mounting arms 176 are rigidly interconnected by an upwardly projecting, substantially U-shaped brace 178 having an upper transverse cross portion 180. A substantially straight axle 182 is mounted subjacently on the arms 176 to define an axis of rotation substantially parallel to the transverse dimension of the frame 20. A wheel 184 having a pneumatic tire 186 is mounted on the axle 182 for free rotation thereof about an axis of rotation in supporting relation to the frame 20 for earth traversing movement. The axles are rotatable about a substantially common axis of rotation parallel to the frame. A hydraulic ram member 190 having a cylinder portion 192 and a piston 194 of substantially conventional construction is pivotally mounted on the wheel assembly. The cylinder portion 192 is secured on the upright plate 174 for pivotal movement thereof about an axis substantially parallel to the axis of rotation of the axle 182. The piston 194 is secured at its free end on the cross portion 180 of the U-shaped brace 178 for pivotal movement thereof about an axis substantially parallel to that about which the cylinder portion 192 is adapted to be moved. Thus, as is described in greater detail in the Operation hereof, extension and retraction of the piston out of and into the cylinder effects a downward or upward movement, respectively, of the wheel 184 relative to the frame whereby the forward portion 33 of the frame can be raised or lowered, respectively, relative to a surface upon which the wheel 184 is disposed.

The rearward portion of the frame 35 mounts a pair of substantially identical, L-shaped wheel support members 200 spaced transversely from each other. The L-shaped support members are preferably of sturdy, rigid, metal construction. Each support member 200 mounts one of the second pair of wheel assemblies 28. Each such wheel assembly provides a frame substantially identical to the frames 170 of the first pair of wheel assemblies 27 in dimensions and construction and therefore the description immediately preceding of the frame 170 will be understood as equally applicable to frame 170 of each of the second pair of wheel assemblies 28.

Figure 7:
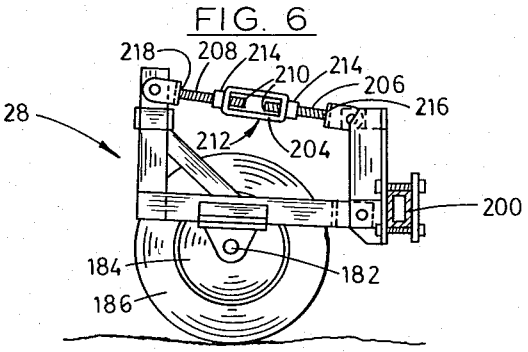
FIG. 7 is a somewhat enlarged side elevation of a portion of the device taken on line 7—7 in FIG. 1.
Figure 16:
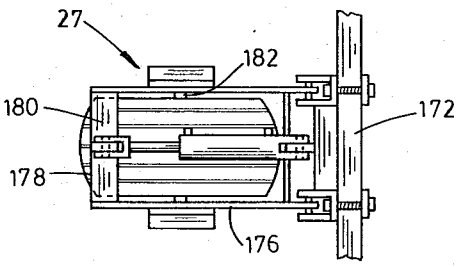
FIG. 16 is a top plan view of the portion of the device shown in FIG. 6.

However, as will be understood by reference to FIG. 7, a turnbuckle portion 204 is substituted for the hydraulic ram member 190 in each of the second pair of wheel assemblies 28. As shown in FIG. 7, the turnbuckle portion provides a first, elongated, screw-threaded rod 206 and a second, elongated, screw-threaded rod 208, each having an adjustment end portion 210 screw-threadably adjustably received within a turnbuckle 212 mounting conventional screw-threaded adjustment nuts 214. The first rod 206 provides a second end portion 216 pivotally secured on the upright plate 174 for pivotal movement thereof about an axis substantially parallel to the axis of rotation of the wheel 184. The second rod 208 provides a second end portion 218 pivotally secured on the U-shaped brace 178 for pivotal movement thereof about an axis of rotation substantially parallel to the axis about which the second end 216 of the rod 206 is adapted to be moved. While the operation of each of the second pair of wheel assemblies 28 is further described below, it will be seen that relative adjustment of the turnbuckle portion 204 to dispose the second ends 216 and 218 nearer to or farther from each other will effect a relative raising or lowering, respectively, of the arms 176 and a consequent lowering or raising of the rearward portion of the frame 35 relative to an earth surface upon which tire 186 is disposed.

Figure 14:
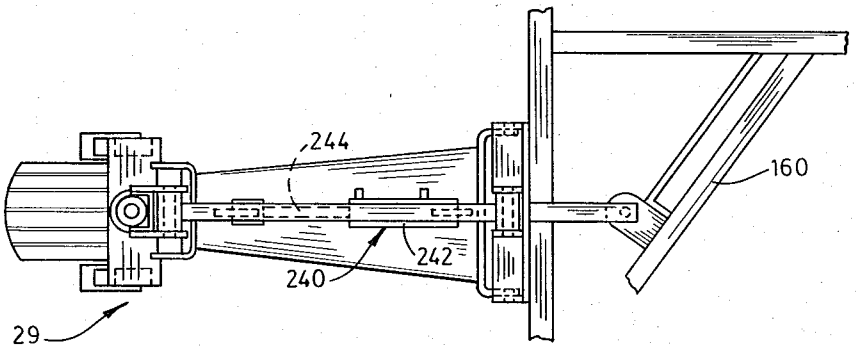
FIG. 14 is a top plan view of the portion of the device shown in FIG. 8.
Figure 8:
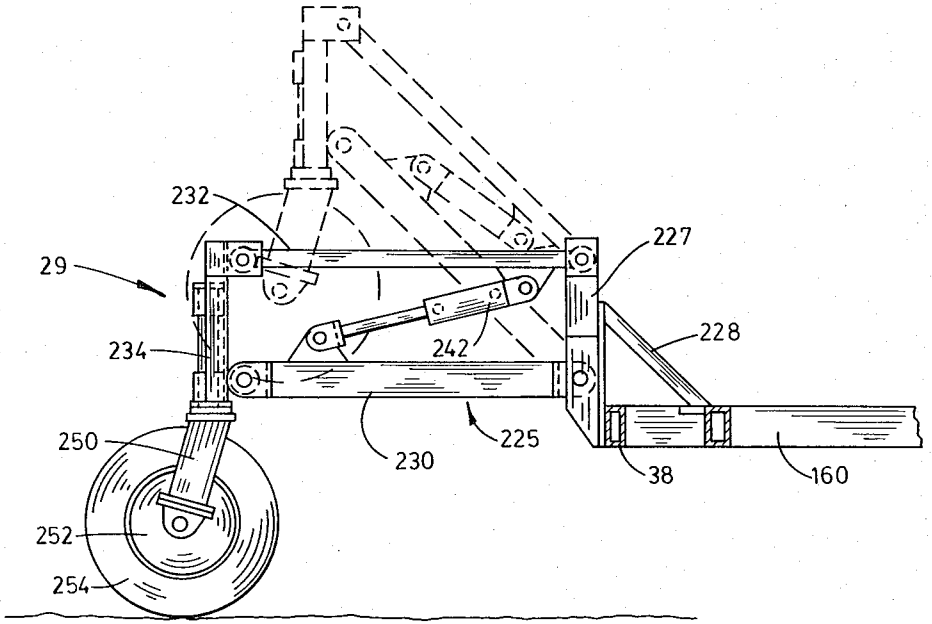
FIG. 8 is a somewhat enlarged view of a portion of the leveling device of the present invention taken on line 8—8 in FIG. 1 and showing a portion thereof in an alternate position in phantom lines.

The caster wheel assemblies 29 are secured in tandem spaced relation on the rearward transverse brace 49, as is best seen by reference to FIGS. 1, 8 and 14. As shown therein, each assembly 29 provides a frame 225 having an upwardly projecting, mounting portion 227 secured as by bolts, welding or the like on transverse beam 38. Further structure support is provided by a brace 228 forwardly extending and secured as by welding or the like on strut 160. A substantially flat, first mounting arm 230 is secured on the mount portion 227 for pivotal movement thereof about an axis of rotation substantially parallel to the transverse beam 38. An elongated, substantially straight, second mounting arm 232 is pivotally secured on the mounting portion 227 spaced from the first mounting arm 230 for pivotal movement thereof about an axis of rotation parallel to that about which the first mounting arm 230 is adapted to be moved. The frame 225 further provides an elongated linkage portion 234 spaced from the mounting portion 227 and pivotally secured on the first and second mounting arms to maintain the mounting arms in substantially parallel relation. A hydraulic ram member 240 is provided having a cylinder end portion 242 secured on the first mounting arm in proximity to the mounting portion 227 and an opposite piston portion 244 secured on the second mounting arm remote from the mounting portion 227. A bracketed wheel mount 250 is secured on the frame 225 for free pivotal movement thereof about an axis substantially perpendicular to the axis about which the first mounting arm 230 and second mounting arm 232 are adapted to move. The wheel mount 250 receives a wheel 252 having a tire 254 for rotation thereof about an axis of rotation substantially perpendicular to the axis of rotation of the wheel mount 250 whereby the caster wheel assemblies 29 each operate in the manner of a conventional caster in that the wheels thereof are pivotable to dispose the axis of rotation thereof substantially perpendicularly to the direction of a force exerted thereagainst. As will be described in greater detail below, retraction of the piston portion 244 into the cylinder portion 242 serves to elevate the frame 225 of the caster wheel assemblies 29 relative to the frame 20 of the device 10.

As can best be seen by reference to FIGS. 1 through 5, the frame 20 mounts a hitching assembly 270 on the forward portion 33 thereof. The hitching assembly provides a pair of linking units 272 adapted pivotally to be secured to the rearwardly projecting lower draft arms 275 of a conventional tractor 11 depicted schematically in FIGS. 1 and 2. The linking units are spaced from each other substantially equidistantly about the midline 21 and are secured as by welding or bolts or the like on forward transverse brace 48. An upright post 280 is secured in upstanding relation on the transverse brace 48. The post mounts a substantially flexible linkage unit 282 adapted for pivotal connection on the upper draft arm 285 of the conventional tractor 11 or the like. The flexible linkage unit 282 can be made lengthadjustable by the incorporation therein of a turnbuckle or the like, as shown in FIG. 2. It is preferable that the linkage unit 282 be of substantially flexible construction such as a chain or other flexible cord-like member of substantial tensile strength.

The frame 20 mounts a sensing device 290, preferably although not necessarily secured on the upright post 280, adapted to function to sense movement of the forward portion 33 of the frame 20 from a substantially horizontal attitude of disposition. The sensing device 290 can be constructed in the manner of a conventional mercury switch or other level-sensing device. Of course, if the sensing device 290 is mounted in the upright post 280, movement of the upright post from a vertical attitude will be accordingly sensed by the sensing device 290 as indicating movement of the forward transverse brace 48 from a substantially horizontal attitude.

Figure 15:
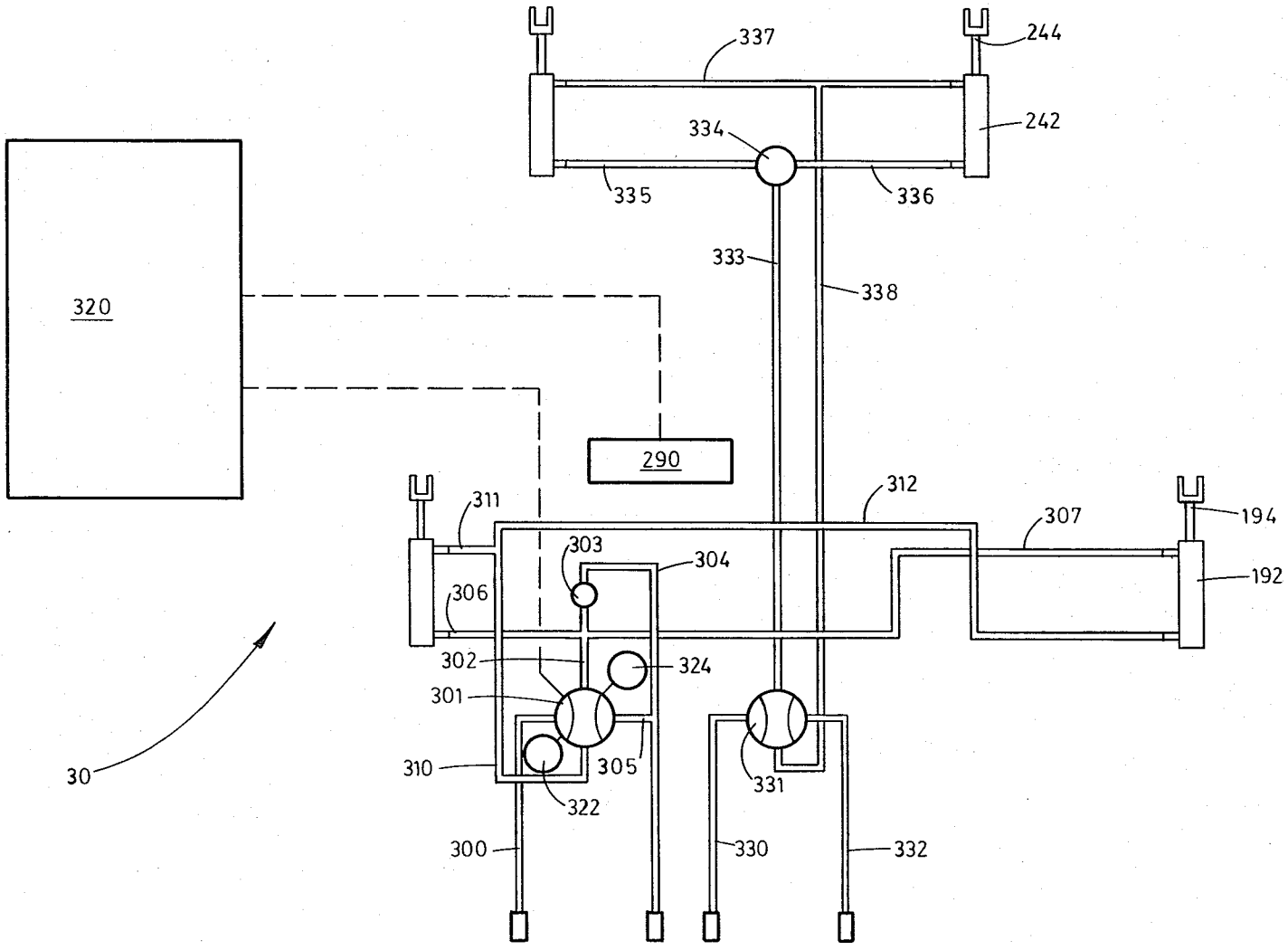
FIG. 15 is a schematic diagram of the hydraulic assembly of the device of the present invention.

The device 10 further incorporates a hydraulic assembly 30 depicted schematically in FIG. 15 and omitted from the remainder of the FIGS. to avoid congestion thereof. As shown in FIG. 15, the hydraulic assembly is adapted for connection to a hydraulic reservoir and pumping mechanism of substantially conventional construction and design, not shown. As shown in FIG. 15, the hydraulic assembly 30 provides a first supply line 300 adapted for connection in receiving relation to the hydraulic reservoir. The supply line 300 is connected to a four-way valve 301. A supply line 302 connects the four-way valve 301 with an electric solenoid-operated flow control valve 303 operable in the manner of a bleed valve and preferably having an adjustable or selectively variable flow rate. A fluid return line 304 interconnects the electric solenoid flow control valve 303 and the hydraulic reservoir, not shown, for return of fluid thereto. A fluid return line 304 connects the four-way valve 301 with the hydraulic return line 304. Hydraulic line 306 connects hydraulic line 302 with hydraulic cylinder 192 in driving or extending relation to the piston member 194 of the hydraulic ram member 190. Hydraulic flow line 307 connects flow line 302 with the hydraulic cylinder 192 of the second hydraulic ram member 190 in retracting relation to the piston 194 thereof, the operation of which is described in greater detail below. Hydraulic flow line 310 connects the four-way valve 301 and connects remotely to the hydraulic cylinder 192 to hydraulic flow line 311 in retracting relation to the piston 194 thereof. Hydraulic flow line 310 also connects to hydraulic flow line 312 which connects to the second hydraulic cylinder 192 in driving relation to the piston 194 thereof. The four-way valve 301 is connected to electrical control box 320 through a pair of valve operating members 322 and 324. The sensing device 290 is connected electrically to the control box 320 to signal the operation of control devices 322 and 324, as will be described in greater detail below.

A second supply line 330 is provided for attachment to the hydraulic reservoir in fluid receiving relation thereto. Hydraulic line 330 is connected to a four-way valve 331. A return line 332 is connected to the four-way valve 331 in fluid receiving relation thereto and is adapted for connection to the hydraulic reservoir in fluid delivery relation. Hydraulic flow line 333 is connected to the four-way valve 331 and connects remotely to flow divider 334. Flow lines 335 and 336 are connected to flow divider 334 and flow lines 335 and 336 individually connect in fluid flow relation to hydraulic cylinders 242 mounted on caster wheel assemblies 29 in driving or extending relation to the piston portions 244 thereof. Hydraulic flow line 337 is connected in fluid flow relation on the hydraulic cylinders 242 in retracting relation to the piston portions 244 thereof. Hydraulic flow line 338 interconnects flow line 337 and the four-way valve 331.

Flow of hydraulic fluid through that portion of the hydraulic assembly connected to the caster wheel assemblies 29 is manually directed by conventional controls mounted on the tractor and operable by the operator thereof.

OPERATION

The operation of the described embodiment of the present invention is believed to be readily apparent and is briefly summarized at this point.

Prior to use of the land leveling device 10 for leveling earth surfaces, the device is first linked to a conventional tractor or the like to permit towing thereof by the tractor. As can best be seen in FIGS. 1 and 2, the tractor is first disposed to align the draft arms 275 thereof with the linkage units 272 of the hitching assembly 270. In such an attitude, the upper draft arm 285 is pivoted to permit attachment of the flexible linkage unit 282 thereon. The draft arms 275 and upper draft arm 285 are then operably connected to the linkage units 272 and the flexible linkage 282. Hydraulic lines 300, 304, 330 and 302 are connected to the reservoir. Upper draft arm 285 is then elevated toward a substantially upright attitude, first to tension the flexible link 282 to exert an upwardly directed pulling force on the upright post 280 and, consequently, the forward portion 33 of the frame. The upper draft arm 285 is upwardly extended until the first or forward blade assembly 22 is clear of the ground. The hydraulic ram members 240 are subsequently, or at the same time, operated hydraulically to extend the piston portions 244 of the caster wheels 29 from the cylinders 242, thus effecting a relative downward movement of the mounting arms 230 and 232 and a consequent elevation of the rearward portion 35 of the frame 20. To accomplish this, flow is directed through the flow line 330 from the hydraulic reservoir through the four-way valve 331, flow line 333 and flow lines 335 and 336. Upon substantially complete extension of the piston 244, the rear portion 35 of the frame is disposed in an elevated attitude relative to the ground surfaces whereby the forward blade assembly 22 and rearward blade assembly 25 are elevated above the ground. In such an attitude, the leveling device 10 can be towed behind the tractor to a selected operative environment. Preferably, the device is similarly disposed when making turns in the operation of the device to carry the device from one course to be leveled to another spaced therefrom.

It has been found that particularly when the tractor is engaged in turning, the weight of the device has a tendency to effect a downward force on the upper draft arm 285 through the flexible link 282. Therefore, it is desirable that the flexible link be flexible rather than tensioned or substantially rigid to avoid communication of such upward movement of the forward portion of the tractor to the forward portion 33 of the frame 20, which would otherwise cause a buckling or binding effect on the forward portion 33.

The tractor is operated to tow the device into proximity with the intended operative environment, which, for illustrative purposes, can be a course of selected width disposed between a pair of berms or raised soil surfaces, such as are commonly found in orchards of almond trees and the like. The tractor and device 10 are disposed to align the midline 21 of the frame 20 substantially in line with the center of the intended course of travel. The forward blade assembly 22 and rearward blade assembly 25 are then adjusted in accordance with the soil conditions anticipated to be encountered and the width of the course to be leveled.

The outer blade 77 of each of the forward blade subassemblies 52 is first adjusted to extend the outer end portion 72 to a desired degree of extension, as determined by the width of the course. The nut 110 is loosened on each of the bolts 106 and the outer blade 77 is slid lengthwise to move the bolts 106 within the channels 68 of the brackets 65. When disposed in a preferred attitude of extension, the nut is retightened securely to hold the outer blade 77 in such selected attitude. The inner blade 75 is then adjusted similarly to dispose the inner end portion 70 of each blade subassembly in a desired attitude of proximity relative to the midline 21. Such adjustment is dictated in large part by the anticipated volume of soil to be gathered by the forward blade assembly 22 as the device 10 is towed along the course by the tractor 11. It is desirable that the inner end portions 70 be brought into sufficient proximity to insure the formation of a mound or berm therebetween as the device is towed into engagement with the soil to be leveled, as will become apparent from the description below. Essentially, where small amounts of soil are anticipated to be gathered by the blade subassemblies 52, the inner end portions 70 should be disposed in relatively close proximity to the midline 21. Conversely, if the soil is relatively uneven and a substantial amount of earth grading is necessitated, the inner end portions 70 can be disposed relatively farther apart.

The blades 122 of the rearward blade assembly 25 are then similarly adjusted to dispose the outermost end portions thereof substantially in line with the outer end portions 72 of the forward blade assembly 22.

The first pair of wheels are then adjusted by operation of the hydraulic ram members 190 to extend or retract the piston portions 194 to dispose the lowermost portion of each tire 186 in a plane substantially in common with the cutting edges 92 of the blades. For such purposes, the hydraulic assembly 30 can be manually overridden or operated apart from the automatic operation thereof. Similarly, the second pair of wheels 28 are elevationally adjusted by turning the adjustment nut 214 of each turnbuckle 212 appropriately to move the arms 176 of the frame 170 thereof upwardly or downwardly thereof as desired or required relative to the frame 20 to dispose the lowermost portion of the tire 186 thereof in a substantially common plane with the cutting edges 142 of the blades 122.

In order to commence the land leveling operation of the leveling device 10, the draft arms 275 and 285 are lowered in reverse of the initial elevational operation described above while the rear caster wheels 29 are raised in the reverse of the operation described above to lower the rearward portion 35 of the frame 20. Such lowering operation is performed until the tires 186 are resting on the ground surface.

The amount of soil necessary to be graded or skimmed and the depth of the cut necessary to be made by the blade subassemblies 52 of the forward blade assembly 22 are determined in accordance with the character of the soil and the degree of unevenness or slope thereof transversely to the frame. In order that an entire course can be graded or leveled in a single pass, the operator of the tractor must lower the draft arms sufficiently to bring the cutting edges 92 into substantially complete engagement with soil surfaces. Thus, as can best be seen by reference to FIGS. 3, 4 and 5, the degree to which the inner blades 75 and outer blades 77 penetrate the soil will vary along the forward surfaces thereof from point to point depending upon the relative evenness of the soil. In other words, any soil vertically upward of that soil lying in a common plane with the cutting edges 92 will be engaged by the blade subassemblies 52. Further, it is most desirable to maintain the device 10 at all times during the grading operations to dispose the midline 21 substantially in line with the center of the course to be graded to insure evenness of grading by the front blade assembly and evenness of dispersion, as described below, of the soil so graded.

As the device 10 is moved along a course forwardly longitudinal of its midline 21, the grading blade portion 90 and the forward surface 81 of the deflecting portion 80 of each blade engages the soil as described above. Such longitudinal movement of the blades through the soil will effect a movement of the soil so engaged inwardly and relatively transversely toward the midline 21. Such soil is then forced to collect in a berm or mound having transverse dimensions substantially equivalent to the distance by which the inner end portions 70 are spaced from each other. The berm so formed is engaged by the forward surface 131 and deflecting portion 130 of the shield 120 of the rearward blade assembly 25. The shield 120 acts in the manner of a wedge or sweep longitudinally evenly to bisect the berm so formed and to disperse the soil longitudinally along the blades 122 for even dispersal thereof in a substantially horizontal plane. Excess soil or other matter is dispersed externally transversely of the soil so horizontally disposed and is incorporated in the preexisting boundary berms of the orchard or the like.

In order that the cutting edges 92 of the forward blade subassemblies 52 are maintained in a substantially horizontal plane during the grading operation, the hydraulic assembly 30 is operated in an automatic mode, whereby the first pair of wheels 27 hydraulically operate continuously to level the frame 20 to dispose the frame in a substantially horizontal attitude. As the forward blade assembly engages uneven soil causing deviations therefrom from a substantially horizontal attitude, the sensing device 290 signals the control 320. The control similarly operates control devices 324 and 322 as needed to operate the hydraulic lines connected to the cylinders 192, effecting a general raising or lowering of the arms 176 supporting the wheels 184.

Figure 5:
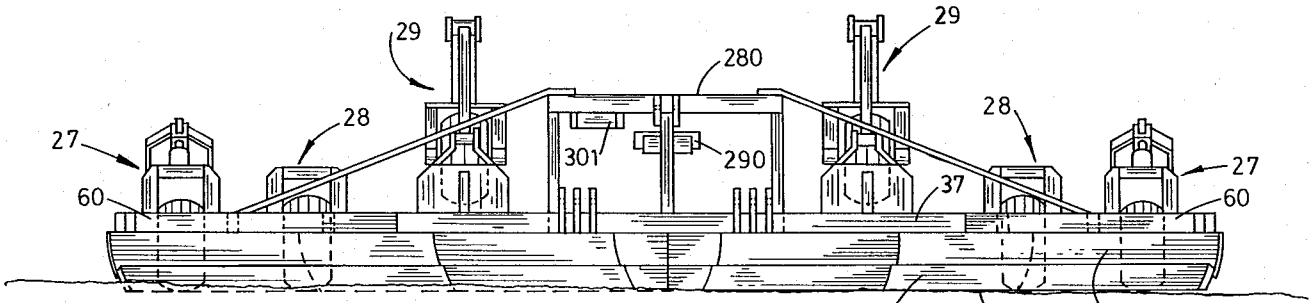
FIG. 5 is a front elevation of the device of FIG. 3, shown in a second alternate typical operative environment.
Figure 4:
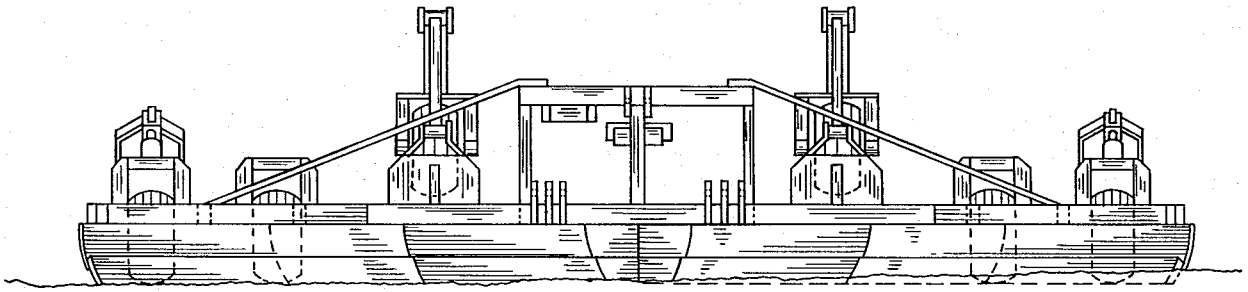
FIG. 4 is a front elevation of the device of FIG. 3 shown in an alternate typical operative environment.
Figure 3:
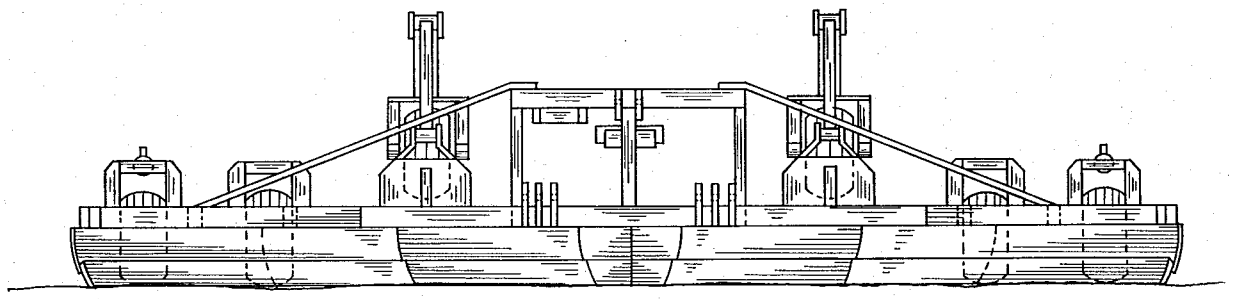
FIG. 3 is a front elevation of the leveling device of the present invention shown in a typical operative environment.

As can be seen from FIG. 15, the hydraulic cylinders 192 are linked in reciprocal fluid flow relation, whereby operation of the four-way valve 301 to direct fluid into lines 306 and 307 will effect an extension of the piston 194 from one cylinder 192 and a retraction of the piston 194 into the opposite cylinder 192. Similarly, operation of four-way valve 301 to direct the flow of hydraulic fluid into flow line 310 will transmit fluid through flow lines 311 and 312, thus causing an effect exactly the opposite of that previously described. Thus, as can be seen in FIG. 5, when the forward blade assembly 22 engages soil relatively higher on the right side of the frame, as viewed forwardly than on the left side, the right-hand wheel 184 is caused to move upwardly relative to the frame, while the left-hand wheel 184 is caused to move downwardly by a similar amount relative to the plane of the frame. Thus, the frame is maintained in a substantially level, horizontal attitude. The reverse of this situation is illustrated in FIG. 4 and the operation is substantially identical, excepting that the wheels move upwardly and downwardly opposite to that previously described.

Due to the manner in which the hydraulic system operates, it is essential, particularly when soft or extremely uneven soil is to be encountered, that flow control 303 be adjusted properly to compensate for possible pressure and heat build-up within the system. Flow control 303 acts as a bleed valve constantly to bleed a portion of the hydraulic fluid within the system back to the return line 304 and hence to the reservoir. Such bleeding is essential not only to avoid the contamination and associated heat build-up, but also to prevent over-responsiveness of the entire system to changing degrees of gradation of earth surfaces.

Thus, it will be seen that the device 10 of the present invention provides an apparatus useful for grading virtually any earth surface, regardless of the degree of transverse unevenness thereof with an ease and efficiency heretofore unattainable. Further, the present invention provides a device adjustable to grade earth surfaces disposed in courses of varying widths and to level the soil thereof in a substantially common horizontal plane in even a single pass along such surfaces.

Although the invention has been herein shown and described in what are conceived to be the most practical and preferred embodiements, it is recognized that departures may be made therefrom within the scope of the invention, which is not to be limited to the illustrative details disclosed.

Having described my invention, what I claim as new and desire to secure by Letters Patent is:

1. A land leveling device comprising a frame having forward and rearward end portions; a pair of elongated blades mounted in the forward end portion of the frame and rearwardly convergent therefrom; a pair of elongated blades mounted on the rearward end portion of the frame and forwardly convergent therefrom, the blades each having a downwardly disposed edge for scraping engagement with the soil; means supporting the forward blades for earth traversing movement forwardly with the frame and for transverse tilting adjustment to form a somewhat smoothed substantially transversely horizontal path of travel; and means supporting the rearward blades for earth traversing movement forwardly along the smoothed path in following relation to the forward blades and fore and aft tilting adjustment to smooth the path longitudinally; and a pair of elevationally adjustable caster wheels mounted in supporting relation on the rearward portions of the frame selectively to elevate the support means and blades free of the ground for transport and to lower the blades onto the path for scraping engagement therewith.

2. The leveler of claim 1 in which the blades are telescopic and means are provided for locking the blades in telescopic adjustment to predetermine the width of the path.

3. The leveler of claim 1 in which the forward end portion of the frame is adapted for connection to the three-point hitch of a tractor having a pair of lower pivotal draft arms to which the frame is pivotally connected and an upper flexible tension member connected to the frame and to the tractor above the draft arms whereby upward pivotal movement of the forward end of the tractor relative to the frame slackens off on the flexible tension member as required to avoid communicating such upward pivotal movement to the frame and downward pivotal movement of the forward end of the tractor relative to the frame tensions the flexible tension member as required to draw the leveler over the ground.

4. A land leveling device comprising:

A. a substantially flat, rigid frame substantially symmetrical about a midline and having a longitudinal dimension and a transverse dimension, the frame providing a forward portion and a rearward portion spaced longitudinally therefrom;

B. a pair of telescopically adjustable, elongated blade assemblies spaced from each other on the forward portion of the frame oblique to the longitudinal dimension and disposed in an earth engaging attitude;

C. a pair of telescopically adjustable rear blades disposed obliquely to the longitudinal dimension on the rearward portion of the frame;

D. wheel means supporting the frame for land traversing movement forwardly along a selected course substantially parallel to the longitudinal dimension;

E. adjustment means hydraulically operable for maintaining the frame in a substantially horizontal attitude during said earth traversing movement; and F. a coupling member borne by the frame and adapted for attachment on a powered vehicle in towing relation to the frame for causing said earth traversing movement.

5. The land leveling device of claim 4 wherein the blade assemblies each provide a first blade member having an outer end portion remote from the midline, the first blade member being adjustable to move the outer end portion thereof toward and away from the midline; and a second blade member having an inner end portion in proximity to the midline, the second blade member being adjustable to move the inner end portion toward and away from the midline.

6. The land leveling device of claim 5 wherein the first blade member and second blade member of each blade assembly are disposed in partially overlaying relation.

7. The land leveling device of claim 6 wherein land portions engaged by the blade assemblies during land traversing movement of the frame are urged along the blade members thereof toward the midline until such portions are disposed in greater proximity to the midline than are the inner end portions and are disengaged from the blade assemblies.

8. The land leveling device of claim 7 wherein the frame mounts a shield member forwardly of the rear blades and the shield member is disposed to engage land portions disengaged from the blade assemblies to disperse such portions on opposite sides transverse to the midline as the device is moved forwardly.

9. The land leveling device of claim 5 wherein the wheel means include a first pair of wheels mounted on the forward portion of the frame; a second pair of wheels mounted on the rearward portion of the frame; and a third pair of wheels selectively operable to be disposed in sole supporting relation to the rear portion of the frame.

10. The land leveling device of claim 9 wherein the first pair of wheels are operably linked to the adjustment means for elevational adjustment each of the first pair of wheels to maintain the forward portion of the frame in a substantially horizontal attitude.

* * * * *

UNITED STATES PATENT AND TRADEMARK OFFICE

CERTIFICATE OF CORRECTION

PATENT NO. : 4,526,238

DATED : July 2, 1985

INVENTOR(S) : Leslie F. Williams

It is certified that error appears in the above-identified patent and that said Letters Patent are hereby corrected as shown below:

Column 1, line 47, between "be" and "in" insert ---dug---.

Column 6, line 2, delete "owermost" and substitute ---lowermost---.

Column 13, line 28, delete "embodiements" and substitute ---embodiments---.

Signed and Sealed this

*Eighth* Day of *October 1985*

[SEAL]

*Attest:*

DONALD J. QUIGG

*Attesting Officer*

*Commissioner of Patents and Trademarks—Designate*